US005566615A

United States Patent [19]

Barrois

[11] Patent Number: 5,566,615

[45] Date of Patent: Oct. 22, 1996

[54] PRINTING PLATE END CLAMPING APPARATUS

[75] Inventor: Claus D. Barrois, Erlenbach, Germany

[73] Assignee: Koenig & Bauer Aktiengesellschaft, Wurzburg, Germany

[21] Appl. No.: 489,543

[22] Filed: Jun. 9, 1995

[30] Foreign Application Priority Data

Jun. 10, 1994 [DE] Germany ..... 44 20 314.4

[51] Int. Cl.[6] ..... B41F 27/06

[52] U.S. Cl. ..... 101/415.1; 101/378

[58] Field of Search ..... 101/415.1, 383, 101/382.1, 378

[56] References Cited

U.S. PATENT DOCUMENTS

| | | | |
|---|---|---|---|
| 1,927,728 | 9/1933 | Wolff | 101/415.1 |
| 1,966,311 | 7/1934 | Pearson et al. | 101/415.1 |
| 2,745,344 | 5/1956 | Brodie | 101/415.1 |
| 4,250,810 | 2/1981 | Fowler et al. | 101/415.1 |
| 4,742,769 | 5/1988 | Zeller | 101/415.1 |
| 4,833,986 | 5/1989 | Kobler | 101/415.1 |
| 4,864,931 | 9/1989 | Felkl et al. | 101/415.1 |
| 5,072,670 | 12/1991 | Bergmann et al. | 101/415.1 |
| 5,186,108 | 2/1993 | Hillebrand | 101/415.1 |
| 5,396,843 | 3/1995 | Dürr | 101/378 |

FOREIGN PATENT DOCUMENTS

| | | |
|---|---|---|
| 0124008 | 4/1984 | European Pat. Off. . |
| 1121073 | 7/1962 | Germany . |
| 94 10 423.9 | 10/1994 | Germany . |

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

A printing plate end clamping apparatus engages generally Z-shaped beveled plate ends of a printing plate. A pair of spaced plate end securing flanges and a central clamping bar are shaped to cooperatively engage and sandwich the beveled plate ends. The printing plate is secured to the cylinder in a shape conforming manner.

4 Claims, 5 Drawing Sheets

PRINTING PLATE END CLAMPING APPARATUS

FIELD OF THE INVENTION

The present invention is directed generally to a printing plate end clamping apparatus. More particularly, the present invention is directed to a device for clamping printing plates provided with generally Z-shaped ends. Most specifically, the present invention is directed to an apparatus for attaching and clamping printing plates provided with Z-shaped beveled ends to a gravure printing cylinder. The two generally Z-shaped printing plate ends are engaged by acutely angled printing plate end securing flanges which are formed having outer surfaces whose profiles match that of the plate cylinder. A spring biased clamping bar is situated between the two printing plate end securing flanges. As these two flanges are moved radially inwardly, they engage lateral sides of the clamping bar and move the bar radially inwardly. The resulting configuration provides an even, smooth surface for the gravure printing cylinder.

DESCRIPTION OF THE PRIOR ART

Various devices are known in the prior art for use in attaching and clamping printing plates to the surface of rotary gravure printing presses. Such printing plates are typically made of metal and are apt to be relatively stiff. The ends of such gravure printing plates are provided with beveled ends which may have a generally Z-shaped configuration.

In European Patent Publication 0 124 008 A2 there is described a printing cylinder with a device with clamping means for engagement with the beveled ends of a printing plate and which is usable to clamp flexible printing plates. This clamping assembly is disposed in a trough in the plate cylinder and is embodied as triangular segmented bodies, each with a securing edge, and whose outer surface covers the trough gap in the clamped state. The outer surfaces of this device are intended to correspond to the contour or shape of the printing cylinder.

In this prior art device, it is not always the case that the plate will be positioned properly on the cylinder periphery in the area of the securing edge. Even very small form changes in the bevel ends of the printing plate with respect to the securing edge of the cylinder cannot be entirely compensated for. This is particularly true in connection with metal gravure printing plates that are particularly stiff.

A printing plate locking device is shown in German Letters Patent DE-PS 1 121 073 which is usable to attach and clamp printing plates having generally Z-shaped edges. In this prior art device, clamping cheeks push against beveled legs of the printing plate to effect plate clamping. In the course of effecting such a plate clamping, a hollow space or recess is created at the periphery of the printing plate between the ends of the printing plate and the clamping cheek.

In these prior art devices there is created an undesirable enlargement in the area wherein deviation of the shape of the printing plate from the cylinder contour can occur. This is because the printing plate may not rest securely on the surface of the plate cylinder. Particularly when the rotogravure printing process, which uses stiff metal plates, is in use there are frequently created these deviations from the desirable uniform exterior shape of the printing plate cylinder. Such deviations in shape cause an uneven or non-uniform contact pressure between the doctor blade and the cylinder.

This results in ink application problems, such as ink splatters in gravure printing.

In order to obtain guidance of the doctor blade as free from trouble as possible, one proposed solution provided for folding together the edges of the doctor blade and the trough gap, which normally extend parallel with the cylinder axis, for example by adopting a slanted position of the doctor blade. This folding together is limited or constrained because the pressure of the doctor blade against the surface of the plate is changed to an unacceptably large amount with too great a folding. The wear on the doctor blade also becomes too great due to uneven support of the doctor blade. The result is unacceptably high, rapid, and uneven wear of the doctor blade and/or the printing plate.

It will thus be seen that a plate clamping device which overcomes the limitations of the prior art devices is needed. The printing plate end clamping apparatus in accordance with the present invention provides such a device and is a significant improvement over the prior art.

SUMMARY OF THE INVENTION

It is an object of the present invention to provide a printing plate end clamping apparatus.

Another object of the present invention is to provide a device for clamping printing plates, having generally Z-shaped ends, to a plate cylinder.

A further object of the present invention is to provide an apparatus for attaching and clamping gravure printing plates to a gravure plate cylinder.

Yet another object of the present invention is to provide an apparatus for attaching and clamping gravure printing plates having generally Z-shaped beveled ends to a plate cylinder.

Still a further object of the present invention is to provide an apparatus which will adapt the shape of a printing plate clamped to the surface of a plate cylinder exactly and uniformly to the cylinder's contours.

As will be discussed in detail in the description of the preferred embodiment which is set forth subsequently, the printing plate end clamping assembly in accordance with the present invention is particularly usable to attach and clamp gravure printing plates with Z-shaped beveled ends to a gravure printing cylinder. The cylinder has a pair of spaced, pivotable printing plate end securing devices which include plate end securing flanges. These flanges are adapted to engage the beveled, generally Z-shaped ends of the printing plate and have outer peripheral surfaces which have the same curvature as the printing cylinder. These flanges also cooperate to define a trough which extends between them in a direction parallel to the axis of rotation of the printing cylinder. A clamping bar, that has a generally trapezoidal cross-sectional shape, is positioned in the trough and is spring biased radially outwardly. This clamping bar has lateral side faces which end in lower corner ridges. The securing flanges and the clamping bar cooperate to sandwich the beveled, generally Z-shaped ends of the printing plate to effect clamping of the plate on the surface of the plate cylinder.

A significant advantage of the printing plate end clamping apparatus in accordance with the present invention resides in its ability to clamp and hold the beveled ends of the printing plate in a manner which maintains the continuous, uniform profile of the outer surface of the printing cylinder. Particularly in the area in which the plate ends are clamped to the cylinder, the present invention minimizes any hollow or recessed areas that might otherwise be formed. Ink splattering, which is caused during the course of the rotogravure printing process by non-uniform contact pressure of the doctor blade on the gravure printing plate, is prevented. In addition, wear of the sealing material which closes off the trough gap, as well as of the doctor blade, is clearly reduced. This sealing material is automatically removed when the securing edges are undone.

The printing plate end clamping apparatus in accordance with the present invention overcomes the limitations of the prior art devices. It is a substantial advance in the art.

BRIEF DESCRIPTION OF THE DRAWINGS

While the novel features of the printing plate end clamping apparatus in accordance with the present invention will be set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
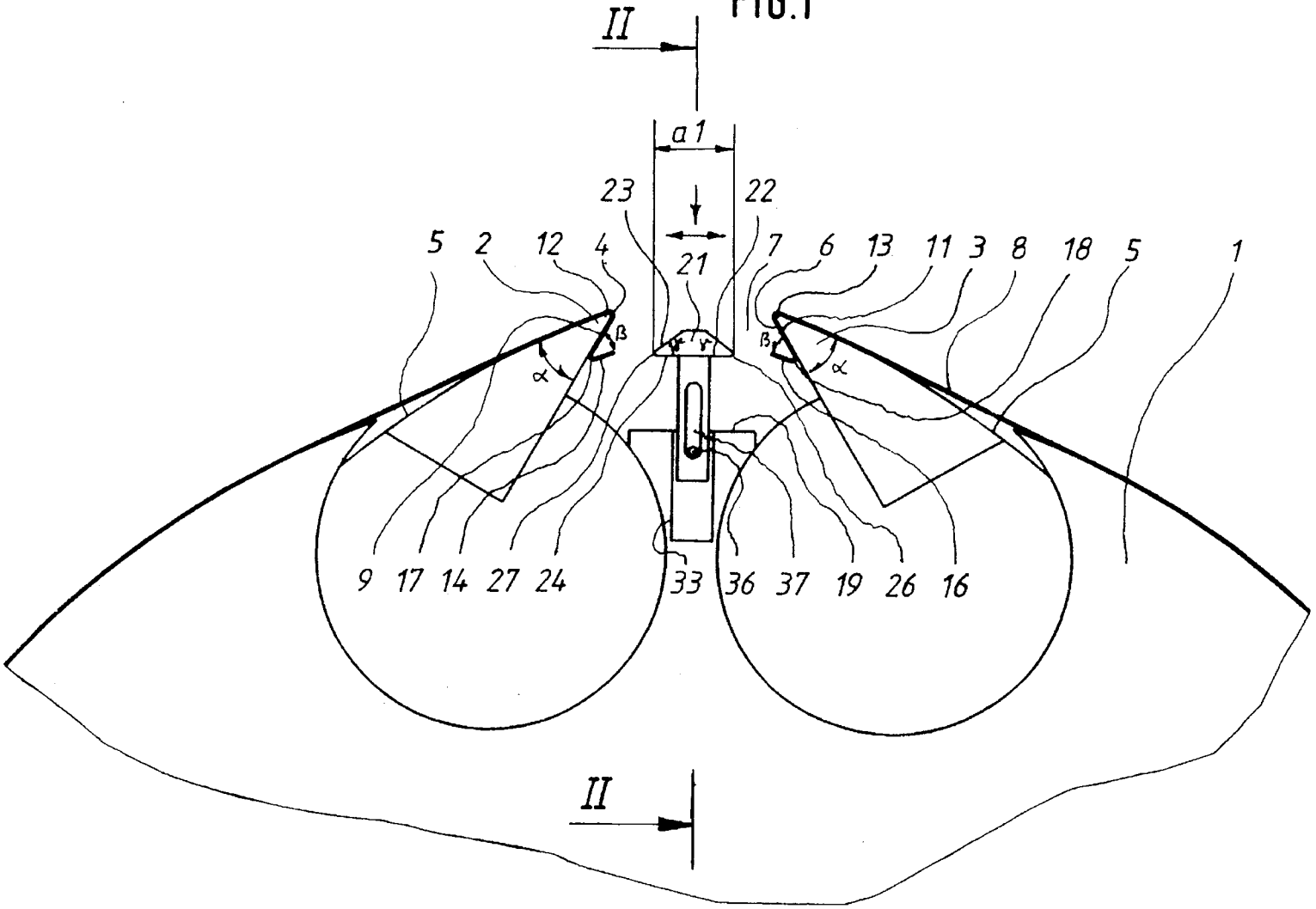
FIG. 1 is an end view of a portion of a printing cylinder showing the present invention with the clamping element open.
Figure 5:
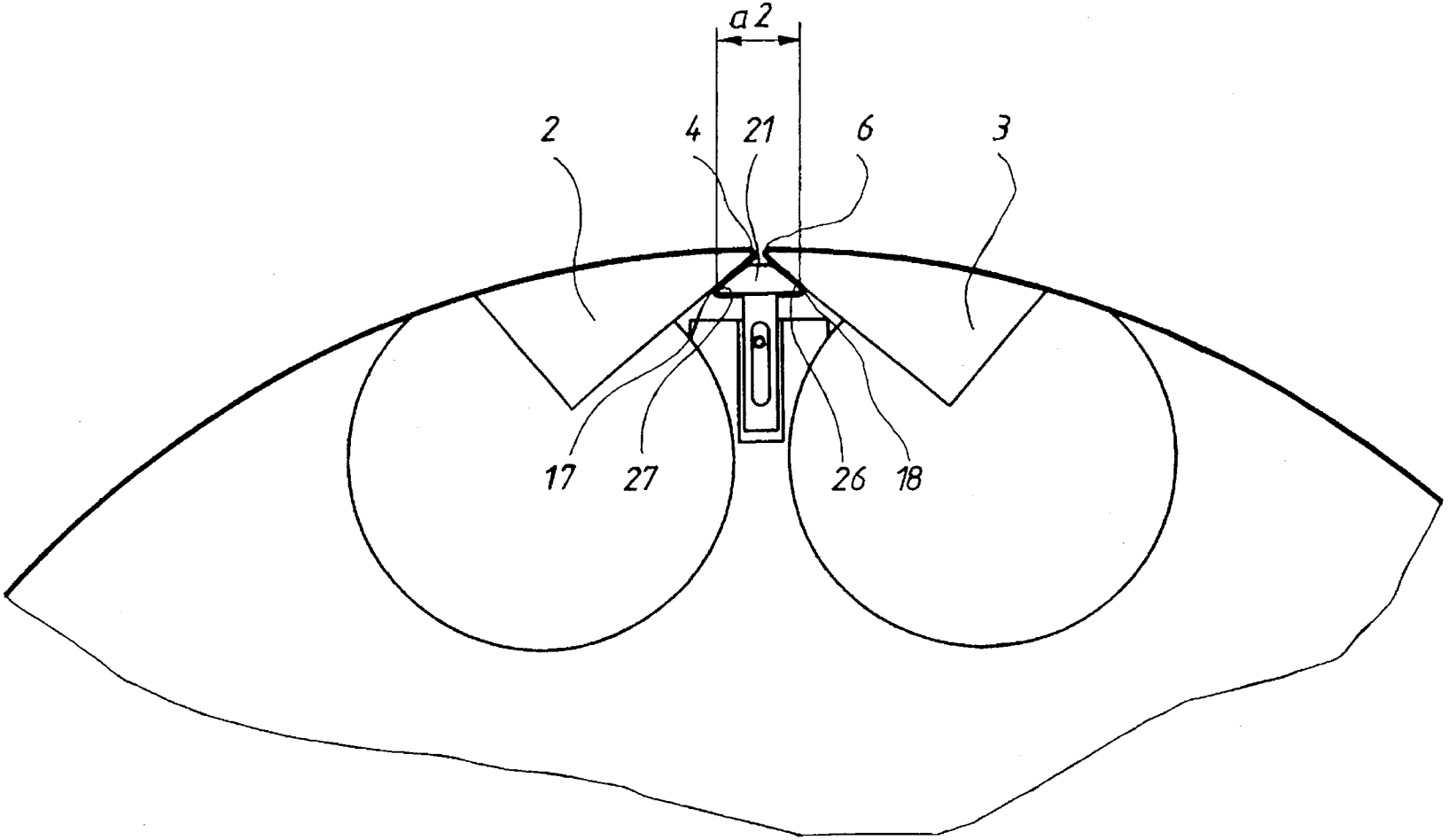
FIG. 5 is a view generally similar to FIGS. 1, 3 and 4 and showing the clamping elements closed.

Referring initially to FIG. 1, there may be seen a gravure printing cylinder, generally at 1, which is provided with the printing plate end clamping apparatus in accordance with the present invention. The gravure printing cylinder 1 is provided with left and right pivotable printing plate end securing devices which, in accordance with the present invention, are configured as axially extending rotatable rods that have left and right pivotable acutely angled printing plate end securing edges or flanges 2 and 3, respectively. The outer surfaces 5 of these pivotable rods and flanges 2 and 3 are adapted to conform to the overall peripheral surface curvature of the gravure printing cylinder 1 so that when the printing plate end securing devices are in their closed or plate clamping positions, as seen in FIG. 5, the surface of the gravure printing cylinder 1 is uniform and continuous. These two pivotable plate end securing flanges 2 and 3 extend across the cylinder 1 parallel to the cylinder's axis of rotation. They are circumferentially spaced from each other sufficiently to define an axially extending groove or cylinder trough 7.

As may be seen in FIGS. 1 and 3–5, a gravure printing plate 8 has left and right generally Z-shaped beveled securing ends 4 and 6 which can be hooked over the left and right plate end securing flanges 2 and 3, respectively. Each beveled securing end 4 and 6 is generally Z-shaped in cross-section and each has an interior acute angle or opening angle of $\alpha$ of generally 45°. Preferably, this opening angle $\alpha$ is slightly less than 45° and may be, for example, 35°. Each of the beveled ends 4 and 6 has a generally radially inwardly extending leg 9 and 11, respectively. In a plate clamping position, as depicted in FIG. 1 and FIGS. 3–6, these legs 9 and 11 extend generally into the cylinder trough 7 and overlie the two securing flanges 2 and 3. These legs 9 and 11 have outer portions which extend inwardly from curved transition portions 12 and 13 of the printing plate beveled ends 4 and 6. These curved transition portions 12 and 13 form the transition from the non-beveled portions of the plate 8 to the legs 9 and 11.

Each leg 9 and 11 has an inner portion which terminates in a finger 14 and 16, respectively. These fingers 14 and 16 form, in cooperation with the legs 9 and 11, a second bevel or angle with an opening angle $\beta$ of up to about 45°. This opening angle $\beta$ is preferably about 35°. Each of these second bevels or opening angles 17 and 18 is directed toward, or opens toward the opposing end 6 or 4 of the gravure printing plate 8. Thus second bevel 17 opens toward leg 11 while second bevel 18 opens toward leg 9. As was discussed previously, the two beveled plate ends 4 and 6 with their curved parts 12 and 13, their legs 9 and 11, their second bevels 17 and 18 and their arms 14 and 16 form generally Z-shaped structures.

As may be seen by again referring to FIG. 1, a plate end clamping bar, generally at 21 is disposed in the cylinder trough 7. This clamping bar 21 is generally trapezoidal in cross-sectional shape and extends along the length of the cylinder trough 7 that is defined by the left and right plate end securing flanges 2 and 3 and which has a cylinder trough bottom 19. As is depicted in FIG. 1 and also in FIGS. 3–4, the clamping bar 21 has an approximately trapezoidal cross-sectional shape which is formed by right and left lateral faces 22 and 23 and a base 24. The lateral faces 22 and 23 each form an angle $\gamma$ with the base 24 of the bar 21. This angle $\gamma$ is preferably from 0.5° to 5.0° less than the opening angle $\beta$ formed by the juncture of the legs 9 and 11 with the inner fingers 14 and 16 of the beveled plate ends 4 and 6 of the gravure printing plate 8.

Corner ridges 26 and 27 are formed on clamping bar 21 at the intersection of the lateral faces 22 and 23 with the base 24 of the bar. These corner ridges 26 and 27 are spaced apart by a distance a1, as seen in FIG. 1. This distance a1 is equal to, or slightly greater than a distance a2 which is depicted in FIG. 5 and which is the spacing between the second bevels 17 and 18 of the gravure printing plate 8 when the plate end securing flanges 2 and 3 are in their closed positions. The base 24 of the clamping bar 21 extends along the length of the cylinder trough 7 parallel to the bottom 19 of the trough. In the closed or clamped position of the plate end securing flanges 2 and 3, as seen in FIG. 5, the fingers 14 and 16 extend parallel to, and engage the base 24 of the clamping bar 21.

Figure 2:
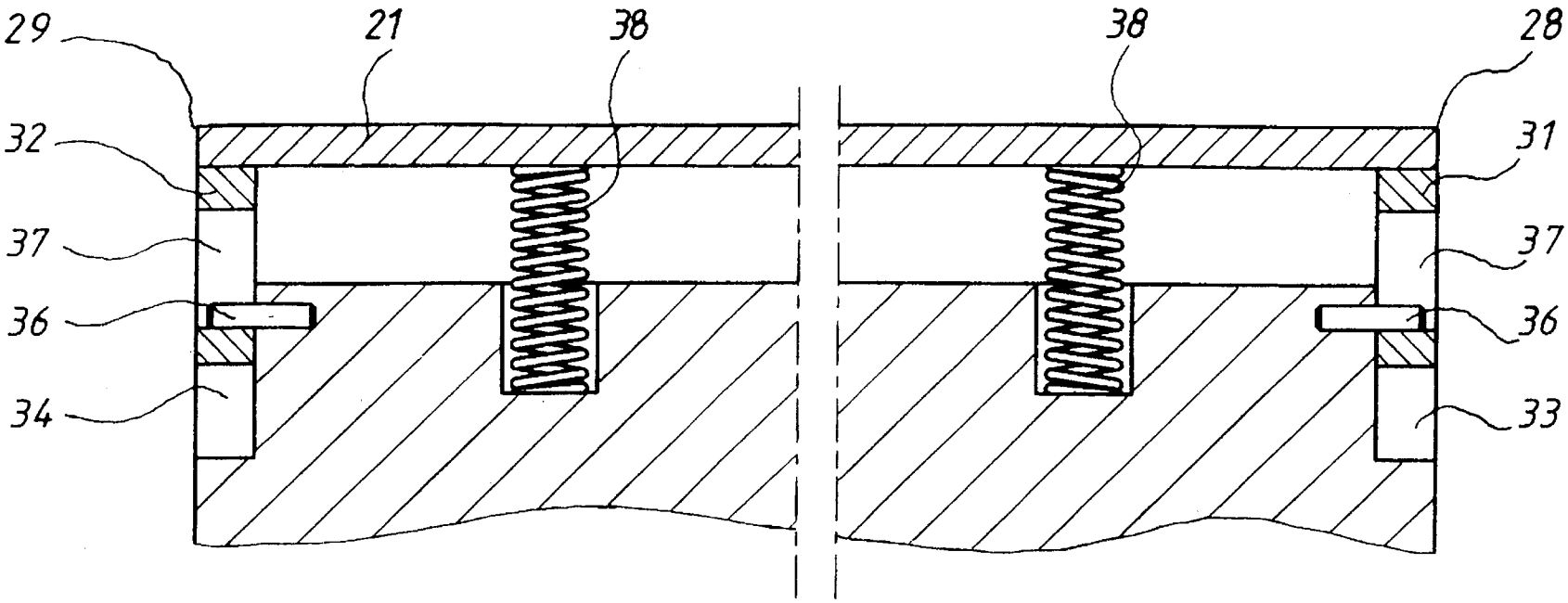
FIG. 2 is an axial sectional view of the subject invention taken along line II—II of FIG. 1.

Referring now primarily to FIG. 2, the clamping bar 21 is supported and guided in cylinder trough 7 for generally radial movement. Each end 28 and 29 of clamping bar 21 has a generally cuboid guide element 31 or 32, respectively. These guide elements 31 and 32 are situated in grooves 33 and 34 which are formed in the end faces of the gravure printing cylinder 1. These grooves 33 and 34, which are located in the end faces of the bottom 19 of the cylinder trough 7, are wider than the cuboid guide elements 31 or 32 which are positioned therein. This insures that the clamping bar 21 is free to move radially, as depicted most clearly in FIGS. 3–5, and can also shift slightly toward one or the other of the second bevels 17 and 18 of the beveled plate ends 4 and 6.

Again referring to FIGS. 1 and 2, each cuboid guide element has a generally ovoid shaped or elongated hole or aperture 37. Each such hole or aperture 37 receives an axially extending bolt or pin 36 that extends out of its respective end face of the bottom 19 of the cylinder trough 7. The shape of each hole or aperture 37 defines the range of travel of the clamping bar 21. Suitable compression springs 38, as seen in FIG. 2, are interposed between the bottom 19 of the cylinder trough 7 and the base 24 of the clamping bar 21. These compression springs 38 thus urge the clamping bar 21 generally radially outward with this outward travel being limited by the engagement of each pin or bolt 36 in its respective elongated hole 37 in its cuboid guide element 31 or 32.

Figure 3:
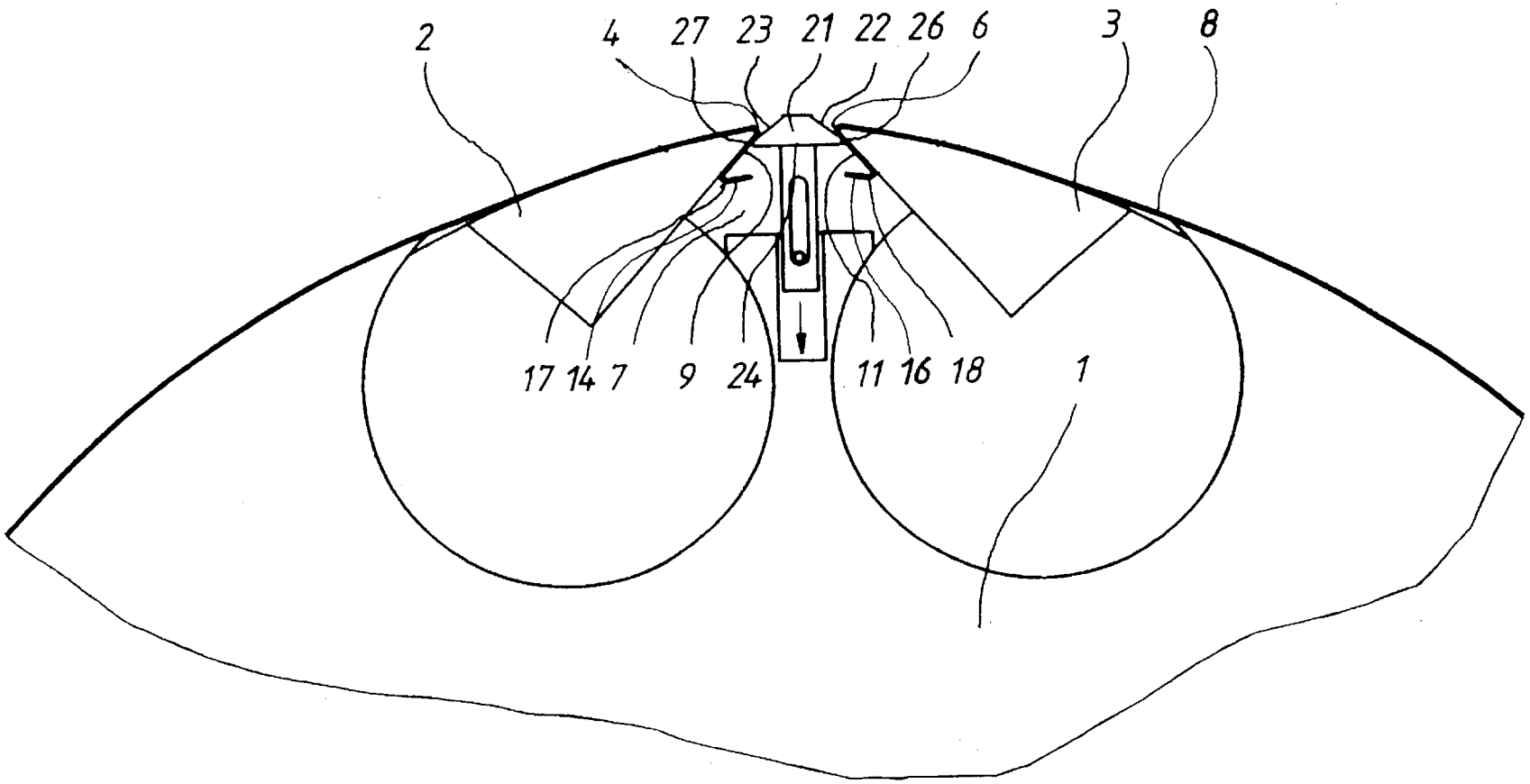
FIG. 3 is an end view of the present invention with the clamping elements starting to close.
Figure 4:
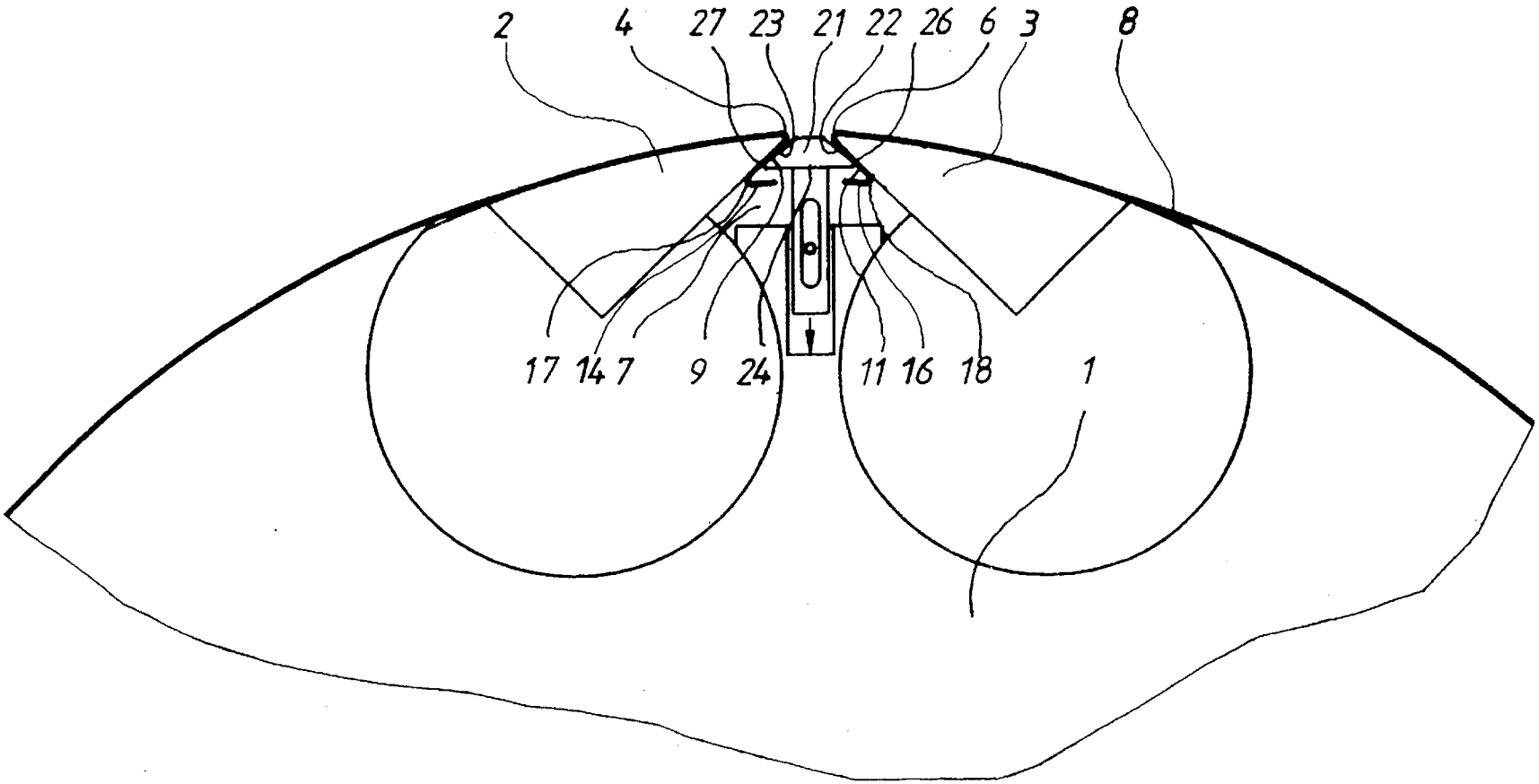
FIG. 4 is a view similar to FIGS. 1 and 3 and showing the clamping elements half closed.

The operation of the printing plate end clamping apparatus in accordance with the present invention will now be discussed in detail and is seen in FIGS. 1 and 3–5. To secure a gravure printing plate 8 to the surface of the plate cylinder 1, the printing plate end securing devices are initially placed in their open positions so that, as depicted in FIG. 1, the plate end securing flanges 2 and 3 are pointed generally radially outwardly. In this position, the beveled plate ends 4 and 6 of the printing plate 8 are placed over the securing flanges 2 and 3. Once this has been done, the flanges 2 and 3 are pivoted radially inwardly, as depicted in FIGS. 3–5, so that these flanges 2 and 3 move generally toward the cylinder trough 7. During this movement of the flanges 2 and 3, the plate end legs 9 and 11 of the beveled printing plate ends 4 and 6 are moved into contact with the lateral faces 23 and 22 of the clamping bar 21. This causes the clamping bar 21 to be moved radially inwardly against the force of the compression springs 38. The movement of the clamping bar 21 is thus into the cylinder trough 7 and generally toward the cylinder bottom 19. In the course of this movement, the fingers 14 and 16 of the beveled plate ends 4 and 6 of the gravure printing plate 8 engage the base 24 of the clamping bar 21. This can be seen most clearly in FIG. 5.

Shortly before the end of the interiorly directed pivoting movement of the plate end securing flanges 2 and 3, the second bevels 17 and 18 of the beveled plate ends 4 and 6 are engaged by the corner ridges 27 and 26 of the clamping bar 21. As the securing flanges 2 and 3 move to their final, plate clamping position, the beveled ends 4 and 6 of the gravure printing plate 1 are firmly engaged by the flanges 2 and 3, are held by the clamping bar 21, and are pulled tight. This interlocking connection insures that the gravure printing plate 8 is properly secured to the plate cylinder 1 and conforms to the contour of the plate cylinder 1, particularly in the area of the plate end securing flanges 2 and 3. This continuous, conforming shape insures that there will be less ink splatters, less doctor blade and printing plate wear, and less ink trough seal wear than has occurred with prior devices.

While a preferred embodiment of a printing plate end clamping apparatus in accordance with the present invention has been set forth fully and completely hereinabove, it will be apparent to one of skill in the art that a number of changes in, for example, the overall size of the printing cylinder, the specific drive assemblies for the cylinder and for the pivotable plate end securing devices, and the like could be made without departing from the true spirit and scope of the present invention which is accordingly to be limited only by the following claims.

What is claimed is:

1. A printing plate end clamping apparatus usable for attaching and clamping gravure printing plates with first and second generally Z-shaped beveled edges to a gravure printing cylinder comprising:

first and second pivotable printing plate end securing devices having printing plate first and second end securing flanges, said flanges being shaped to engage said first and second Z-shaped beveled edges of said printing plate, each of said printing plate end securing flanges having an outer face having a curvature which continues a curvature of said printing cylinder;

a cylinder trough in said printing cylinder and defined by said first and second end securing flanges of said printing plate end securing devices, said cylinder trough having a bottom surface; and a plate end clamping bar disposed for radial movement in said cylinder trough, said plate end clamping bar being biased radially outwardly in said cylinder trough, said clamping bar being generally trapezoidal in cross-sectional shape and having first and second lateral faces and a base, with corner ridges being formed at intersections of said first and second lateral faces and said base, said first and second lateral faces of said clamping bar and said first and second printing plate end securing flanges cooperating to sandwich said first and second beveled edges of said printing plate as said first and second securing flanges are pivotably moved radially inwardly on said plate cylinder to a closed position, said radially movable plate end clamping bar being forced radially inwardly against said bias by said radially inward movement of said first and second plate end securing flanges and forcing said beveled edges of said printing plate against said first and second plate end securing flanges.

2. The printing plate end clamping apparatus of claim 1 wherein each of said first and second beveled ends of said printing plate includes a radially inwardly extending leg and a finger attached to an inner end of each said leg, each said leg and finger defining a bevel having an opening angle which is less than a clamping bar angle formed by each of said clamping bar lateral faces and said clamping bar base.

3. The printing plate end clamping apparatus of claim 2 wherein a first distance between said corner ridges of said clamping bar is less than a second distance between said bevels of said gravure printing plate beveled edges when said printing plate end securing flanges are in said closed position.

4. The printing plate end clamping apparatus of claim 1 wherein said clamping bar has first and second guide elements secured to first and second ends of said clamping bar and further wherein said cylinder trough bottom has first and second end grooves, said first and second guide elements being carried in said first and second end grooves and guiding said radially movable clamping bar.

* * * * *